US007240719B2

(12) United States Patent
Peterson et al.

(10) Patent No.: US 7,240,719 B2
(45) Date of Patent: Jul. 10, 2007

(54) DIE-CASTING SYSTEMS AND METHODS

(75) Inventors: Ron Peterson, Albertville, MN (US); Mark Maas, Northfield, MN (US)

(73) Assignee: QX, Inc., Hamel, MN (US)

( * ) Notice: Subject to any disclaimer, the term of this patent is extended or adjusted under 35 U.S.C. 154(b) by 450 days.

(21) Appl. No.: 10/936,422

(22) Filed: Sep. 8, 2004

(65) Prior Publication Data

US 2006/0048912 A1 Mar. 9, 2006

(51) Int. Cl.
*B22D 33/04* (2006.01)

(52) U.S. Cl. ..... 164/137; 164/113

(58) Field of Classification Search ..... 164/113, 164/137, 118, 312, 348, 342, 339, 319
See application file for complete search history.

(56) References Cited

U.S. PATENT DOCUMENTS

| | | | | |
|---|---|---|---|---|
| 1,347,728 | A | 7/1920 | Wills | |
| 3,009,563 | A * | 11/1961 | Bendix | 199/91 |
| 4,880,792 | A | 11/1989 | Yoshioka et al. | |
| 4,952,131 | A | 8/1990 | Shirai et al. | |
| 4,959,002 | A * | 9/1990 | Pleasant | 425/192 R |
| 5,078,202 | A | 1/1992 | Bai | |
| 5,605,187 | A | 2/1997 | Perrella et al. | |
| 5,832,983 | A | 11/1998 | Kuroda et al. | |
| 5,964,274 | A * | 10/1999 | Brinkley | 164/342 |
| 6,179,606 | B1 | 1/2001 | Müller | |
| 6,450,797 | B1 * | 9/2002 | Joseph | 425/556 |
| 6,637,498 | B1 | 10/2003 | Macheske et al. | |
| 6,955,210 | B2 * | 10/2005 | Matsuura et al. | 164/339 |
| 7,007,361 | B2 * | 3/2006 | La Forest et al. | 29/407.09 |
| 2002/0166652 | A1 | 11/2002 | Macheske et al. | |
| 2003/0150586 | A1 | 8/2003 | Matsuura et al. | |
| 2004/0011498 | A1 | 1/2004 | Salata | |

* cited by examiner

*Primary Examiner*—Kevin Kerns
*Assistant Examiner*—I.-H. Lin
(74) *Attorney, Agent, or Firm*—Leffert Jay & Polglaze, Pa

(57) ABSTRACT

The invention provides die casting systems and methods. A die casting system has two body portions, each having a die insert. A die-insert rack that holds the die inserts thereon and is used for positioning the die inserts between the two body portions is also provided. The rack includes a die-insert-ejection system for pushing the die inserts into the respective body portions. Each body portion may include a plurality of cooling inserts connected in parallel between inlet and outlet channels of a corresponding body portion. One body portion may include a plurality of alignment blocks protruding therefrom, while the other body portion may have a plurality of recesses for respectively receiving the alignment blocks. Each recess may have adjustable sidewalls for adjusting alignment between the body portions.

4 Claims, 11 Drawing Sheets

DIE-CASTING SYSTEMS AND METHODS

TECHNICAL FIELD OF THE INVENTION

The present invention relates generally to casting and in particular the present invention relates to die-casting systems and methods.

BACKGROUND OF THE INVENTION

Die-casting involves injecting molten material into molds (or dies) under pressure. Soft metals, such as aluminum, zinc, copper, and alloys thereof, etc. are typically used in die-casting processes. The dies are usually of a hardened metal, such as hardened steel. A die normally includes two body portions that when butted together close the die to form a cavity within the die that receives the molten metal. The molten metal hardens forming a cast object having an exterior surface that has the shape of an inner surface of the cavity. Separating the two body portions opens the die, and the cast object is ejected.

Die-casting dies are usually expensive and time consuming to manufacture. Moreover, the cost for setting up the dies for the die-casting process is relatively high. For these reasons, die casting is often viewed as an unviable option for manufacturing cast parts, especially for small quantities and prototypes.

As the two body portions are butted together, they are aligned (or registered), e.g., using pins and bushings. That is, bushings in one of the portions receive pins protruding from the other portion for registering the two halves. Improper registration may result in an excessive parting line on the cast object corresponding to where the two body portions met that may require machining or that may produce an unacceptable part. The bushings and/or pins can become worn over time, due to repeatedly opening and closing the die, resulting in improper registration.

The two body portions are usually cooled during casting. This usually involves passing a coolant, such as water, oil, or the like, through a flow passage within each of the body portions. The flow passage typically connects cooling locations within each body portion in series. This means that the coolant heats up as it successively passes from one cooling location to another, which can result in improper cooling.

For the reasons stated above, and for other reasons stated below which will become apparent to those skilled in the art upon reading and understanding the present specification, there is a need in the art for alternative die-casting systems.

SUMMARY

The above-mentioned problems with die-casting systems and other problems are addressed by the present invention and will be understood by reading and studying the following specification.

One embodiment of the invention provides a die-casting system having an external die body comprising first and second body portions and a die insert inserted into an opening of each of the first and second body portions.

Another embodiment of the invention provides a die-casting system having an external die body comprising first and second body portions. Each body portion has a portion of a mold cavity. The first body portion also has a plurality of alignment blocks and the second body portion includes each of a plurality of recesses for receiving a corresponding one of the alignment blocks. Each recess has adjustable sidewalls for adjusting the position of its corresponding alignment block and thereby adjusting alignment between the first and second body portions.

Another embodiment of the invention provides a die-casting system having an external die body comprising first and second body portions. Each body portion has a portion of a mold cavity. Each body portion includes a cooling system. The cooling system has a plurality of cooling inserts connected in parallel between an inlet and an outlet channel of the respective body portion.

Another embodiment of the invention provides a casting die-insert rack including a frame. A die-insert clamp is disposed on the frame. The clamp has a pair of opposing jaws, at least one of the jaws movably attached to the frame. A die-insert-ejection system also disposed on the frame.

Another embodiment of the invention provides a casting die insert adapted to be received in an opening of a body portion of an external die body. The casting die insert includes a lug adapted to be engaged by a latch of the body portion for securing the casting die insert within the opening and for pushing the casting die insert from the opening.

Further embodiments of the invention include methods and apparatus of varying scope.

DETAILED DESCRIPTION

Figure 1:
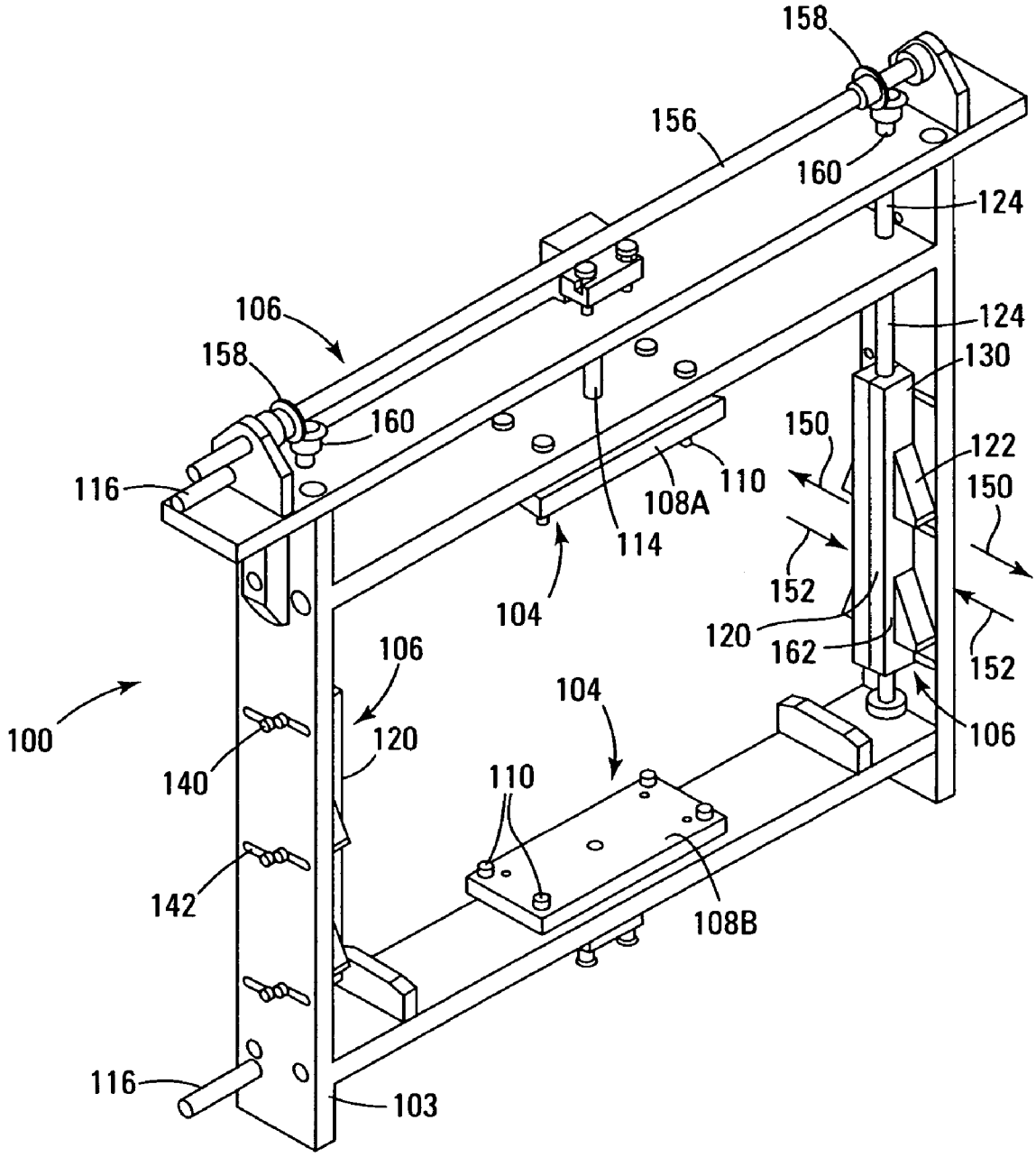
FIG. 1 is an isometric view of a die-insert rack, according to an embodiment of the invention.

In the following detailed description of the invention, reference is made to the accompanying drawings that form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, logical, and electrical changes may be made without departing from the scope of the present invention. The following detailed description is, therefore, not to be taken in a limiting sense, and the scope of the present invention is defined only by the appended claims and equivalents thereof.

The invention in one embodiment is a die casting system having an external die body that includes two distinct body portions, each having an opening for holding a die insert. The die casting system is capable of holding multiple different die inserts that have substantially identical external dimensions but different internal dimensions so that multiple parts can be cast using the same external body and replacing the inserts. Each die insert includes a portion of a mold cavity. When the two body portions, each containing a die insert, are butted together, the die inserts abut so that the mold-cavity portions form the mold cavity.

FIG. 1 is an isometric view of a die-insert rack 100, according to an embodiment of the invention. As shown in the isometric view of FIG. 2 and in FIG. 3, a view taken along line 3—3 of FIG. 2, rack 100 is capable of holding a die insert 200 on each of its sides for movement into position between the two portions of the die body, e.g., by crane, forklift, or the like.

Rack 100 includes a frame 103, a die-insert clamp 104, and a die-insert-ejection system 106. Die-insert clamp 104 includes opposing jaws 108A and 108B each having studs 110 protruding from a face thereof, for one embodiment. For another embodiment, jaws 108 are movably attached to opposing portions of frame 103. For another embodiment, each of jaws 108 slides on rails 112 (FIG. 3) in response to activation of a lead screw 114 (FIGS. 1 and 2), for example, movably attached to each of jaws 108. Lead screws 114 may be respectively activated by applying a torque, e.g., using a crank, motor, etc., to shafts 116 of rack 100 that can impart the torque to lead screws 114 via bevel gears or the like. For one embodiment, lead screws 114 thread through frame 103 when activated.

To secure each of die inserts 200 to rack 100, each die insert 200 is positioned in rack 100 between jaws 108 so that studs 110 align with corresponding holes in either side of each die insert 200. Jaws 108 are closed, i.e., moved toward die inserts 200, so that studs 110 are received in their corresponding holes of die inserts 200, as shown in FIG. 3, and so that jaws 108 squeeze die inserts 200 therebetween.

Figure 4:
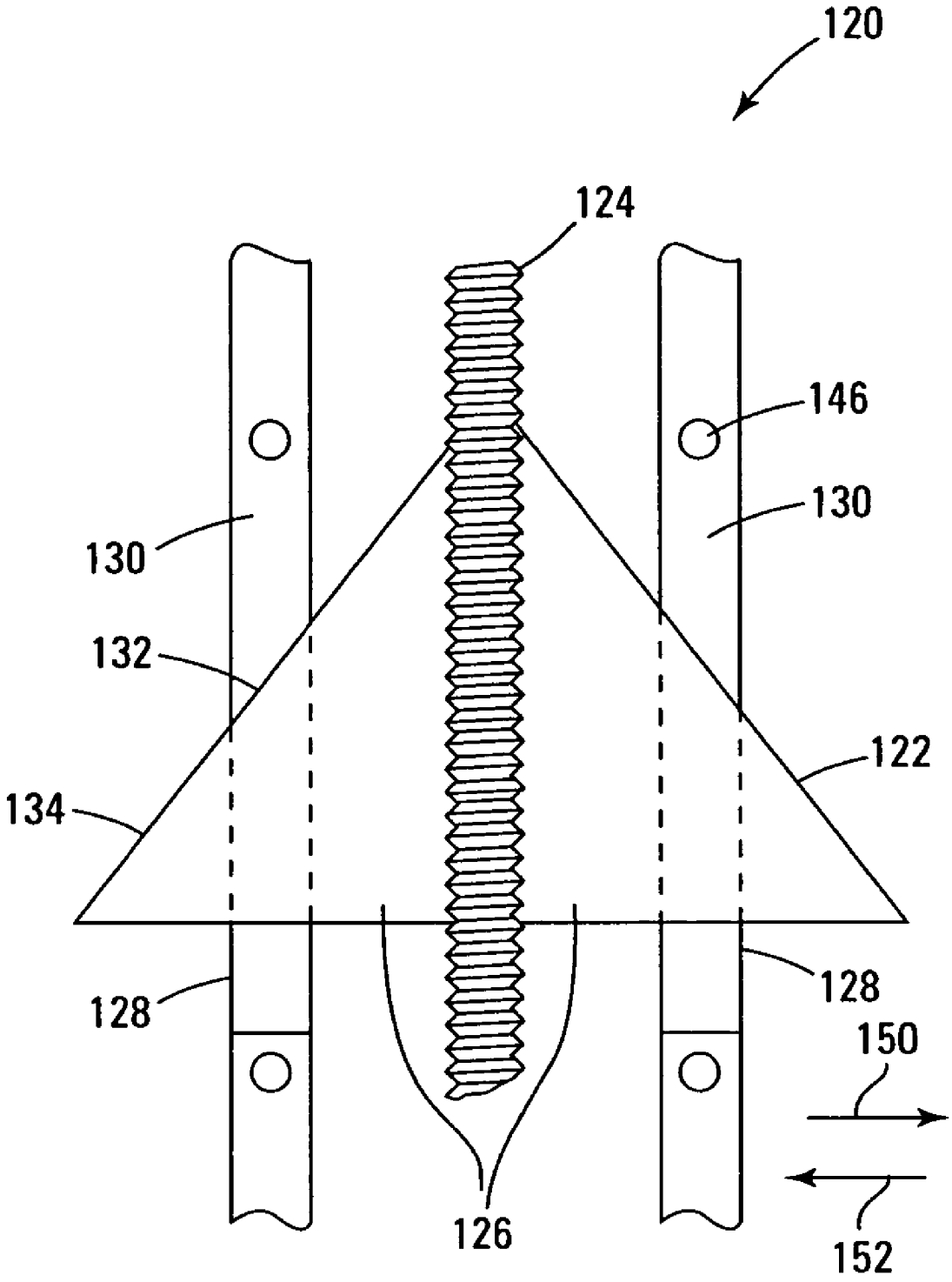
FIG. 4 is detailed view of an ejector of a die-insert rack after having ejected a die insert therefrom, according to another embodiment of the invention.

Die-insert-ejection system 106 includes ejectors 120, as shown in FIG. 1. FIG. 4 is detailed view of an ejector 120, according to another embodiment of the present invention, after having ejected a die insert from rack 100. Each ejector 120 includes triangular-shaped blocks 122 having a lead screw 124 threaded therethrough, as shown in FIGS. 1 and 4. For one embodiment, lead screw 124 divides each of blocks 122 into a pair of wedges 126 (FIG. 4). Each of wedges 126 is disposed in a slot 128 of an ejection bar 130, as shown in FIG. 4. Each slot 128 has an angled surface 132 that mates with an angled surface 134 of its corresponding wedge 126.

As shown in FIG. 1, pins 140 movably attach each ejection bar 130 to rack 100. That is, each pin passes through a slot 142 in frame 103 of rack 100 (FIG. 1) and is received in a corresponding hole 146 of an ejection bar 130 (FIG. 4). Pins 140 may be threaded, pressed, or the like into holes 146 of the respective ejection bars 130. Note that pins 140 are able to slide in their respective slots 142 and thus confine the motion of ejection bars 130 to one dimension in each of the two directions indicated by arrows 150 and 152 in FIGS. 1 and 4.

Figure 2:
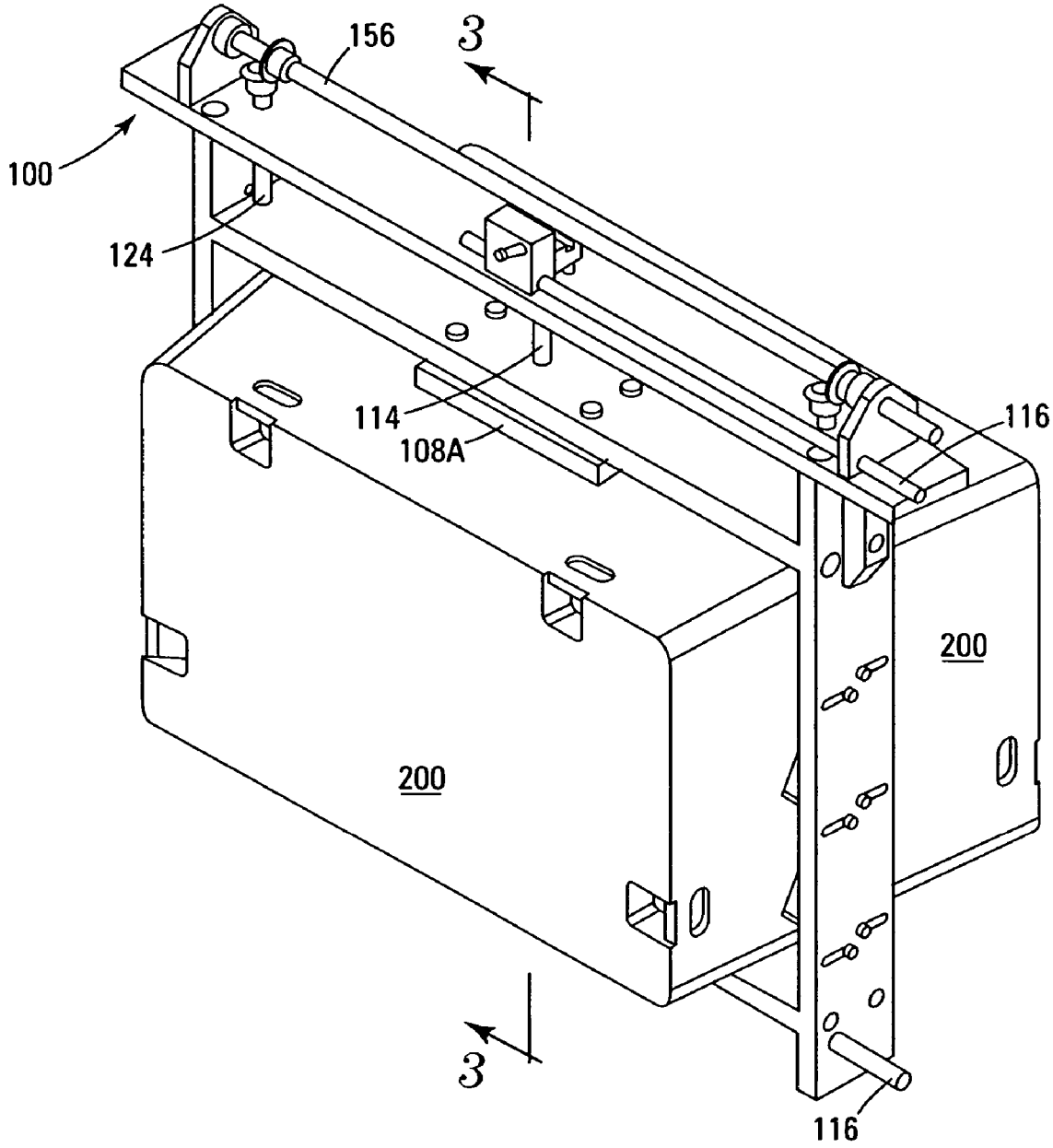
FIG. 2 is an isometric view of a die-insert rack in use, according to another embodiment of the invention.
Figure 3:
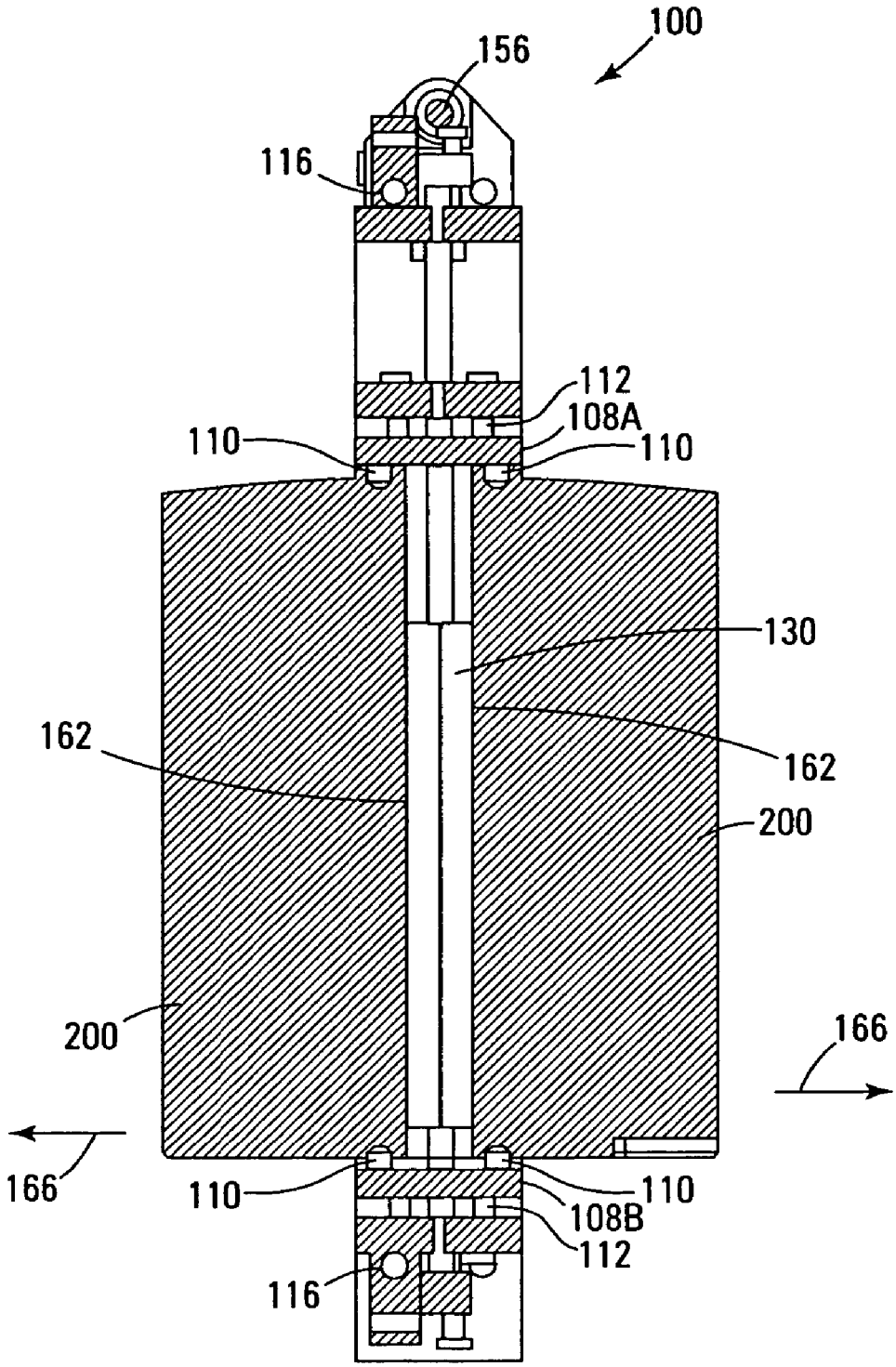
FIG. 3 is a cross-section viewed along line 3—3 of FIG. 2.

For one embodiment, a shaft 156 of ejection system 106 is rotatably attached to frame 103 of rack 100, as shown in FIGS. 1–3, by bearings, bushings, or the like. For another embodiment, bevel gears 158 and 160, respectively attached to shaft 156 and lead screws 124, connect shaft 156 to each of lead screws 124, as shown in FIG. 1. Applying a torque to shaft 156, e.g., using a crank, motor, or the like, activates ejection system 106. Bevel gears 158 and 160 transfer the torque to lead screws 124, causing lead screws 124 to thread into or out of their respective blocks 122. This causes blocks 122 to move up or down, respectively, relative to ejection bars 130.

Moving blocks 122 upward causes surfaces 134 of wedges 126 to ride against angled surfaces 132 of slots 128 of the respective ejection bars 130 (FIG. 4), thus forcing the ejection bars 130 apart. That is, the wedges cause their corresponding ejection bar 130 to move substantially perpendicular to and outward from their respective lead screw in the direction of arrow 150. For one embodiment, ejection bars 130 are biased to move toward their respective lead screw in the direction of arrow 152, e.g., by a spring or springs (not shown). For this embodiment, as the blocks 122 are moved downward, the biasing force keeps surfaces 134 of wedges 126 against angled surfaces 132 of slots 128 of the respective ejection bars 130 (FIG. 4), as ejection bars 130 move together toward their respective lead screw 124. For another embodiment, each lead screw 124 actuates a scissor mechanism, e.g., similar to the type used for scissor jacks, attached between ejection bars 130 that when actuated moves ejection bars 130 together or apart.

As ejection bars 130 move outward while rack 100 is holding inserts 200, a surface 162 of each of ejection bars 130 (FIGS. 1 and 3) respectively engages inserts 200, as shown in FIG. 3, and ejection bars 130 push (or eject) inserts 200 from rack 100 in the direction of arrows 166. Note that prior to ejecting inserts 200 from rack 200, jaws 104 are opened to release inserts 200 therefrom.

Figure 5:
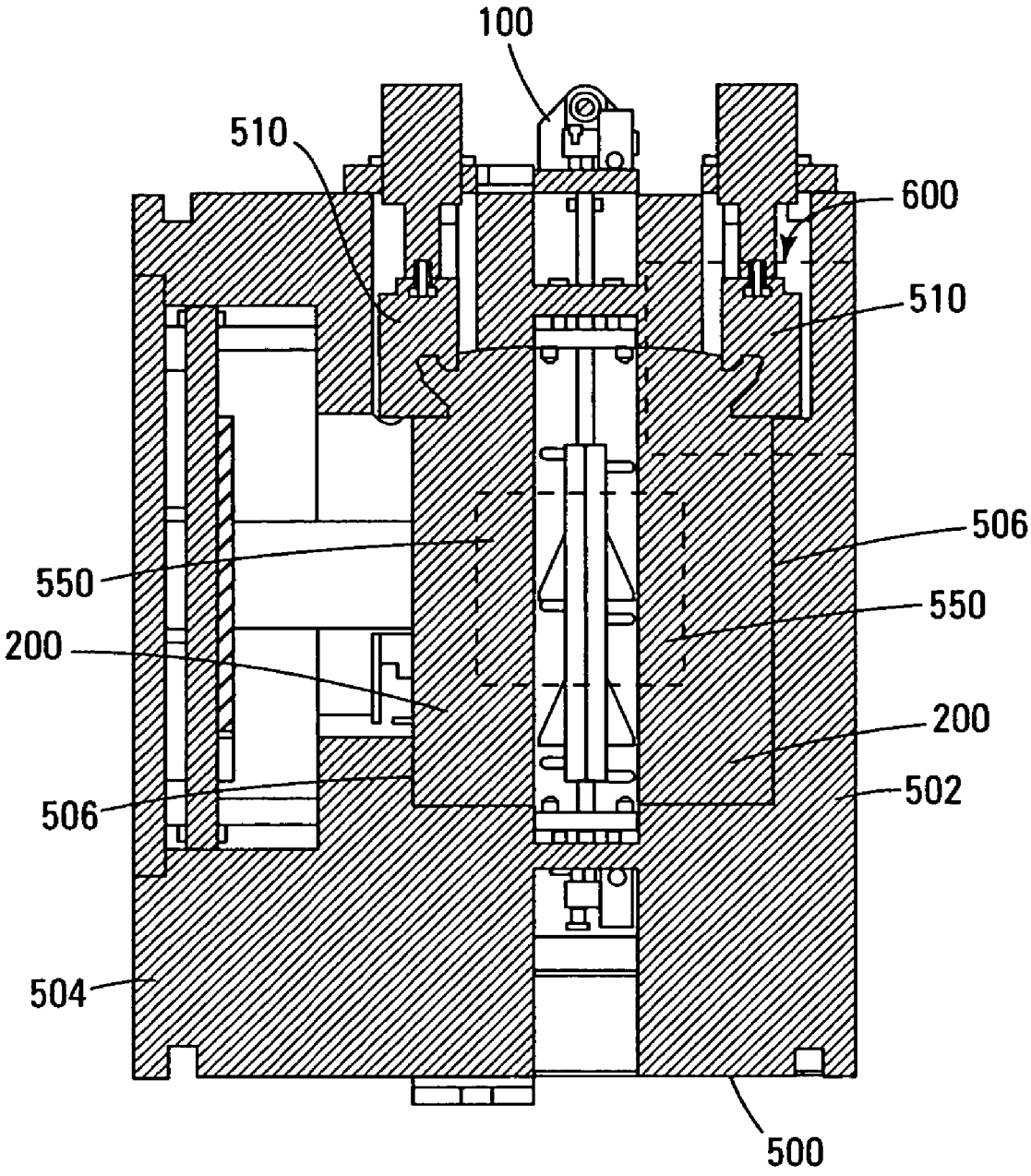
FIG. 5 is a cross-sectional view of a die-insert rack disposed between a pair of body portions of an external die body after die inserts have been ejected therefrom, according to another embodiment of the invention.

FIG. 5 is a cross-sectional view illustrating rack 100 disposed between body portions 502 and 504 of an external die body 500 after inserts 200 have been ejected therefrom, according to another embodiment of the invention. Inserts 200 are respectively received in an opening 506 of body portions 502 and 504. To dispose inserts 200 in their respective body portions 502 and 504, body portions 502 and 504 are initially spread apart, and rack 100, while holding inserts 200, is positioned between body portions 502 and 504 so that inserts 200 respectively align with openings 506. Body portions 502 and 504 are then brought together, sandwiching rack 100 therebetween so that inserts 200 are partially inserted into openings 506. Die-insert-ejection system 106 (FIG. 1) is activated to eject inserts 200 from rack 100 and push inserts 200 the remainder of the way into openings 506, as shown in FIG. 5.

For another embodiment, a cavity insert 550 is inserted within each of die inserts 200, as shown in FIG. 5. Each cavity insert 550 includes a portion of a mold cavity such that when body portions 502 and 504, and thus die inserts 200, are butted together the mold cavity portions form a mold cavity. For one embodiment, each cavity insert 550 may be secured within its respective die insert 200 by bolting or other suitable method. Die inserts 200 are capable of holding different cavity inserts 550 that have substantially identical external dimensions but different internal dimensions so that multiple parts can be cast using the same die inserts 200 and replacing the cavity inserts 550.

Figure 6:
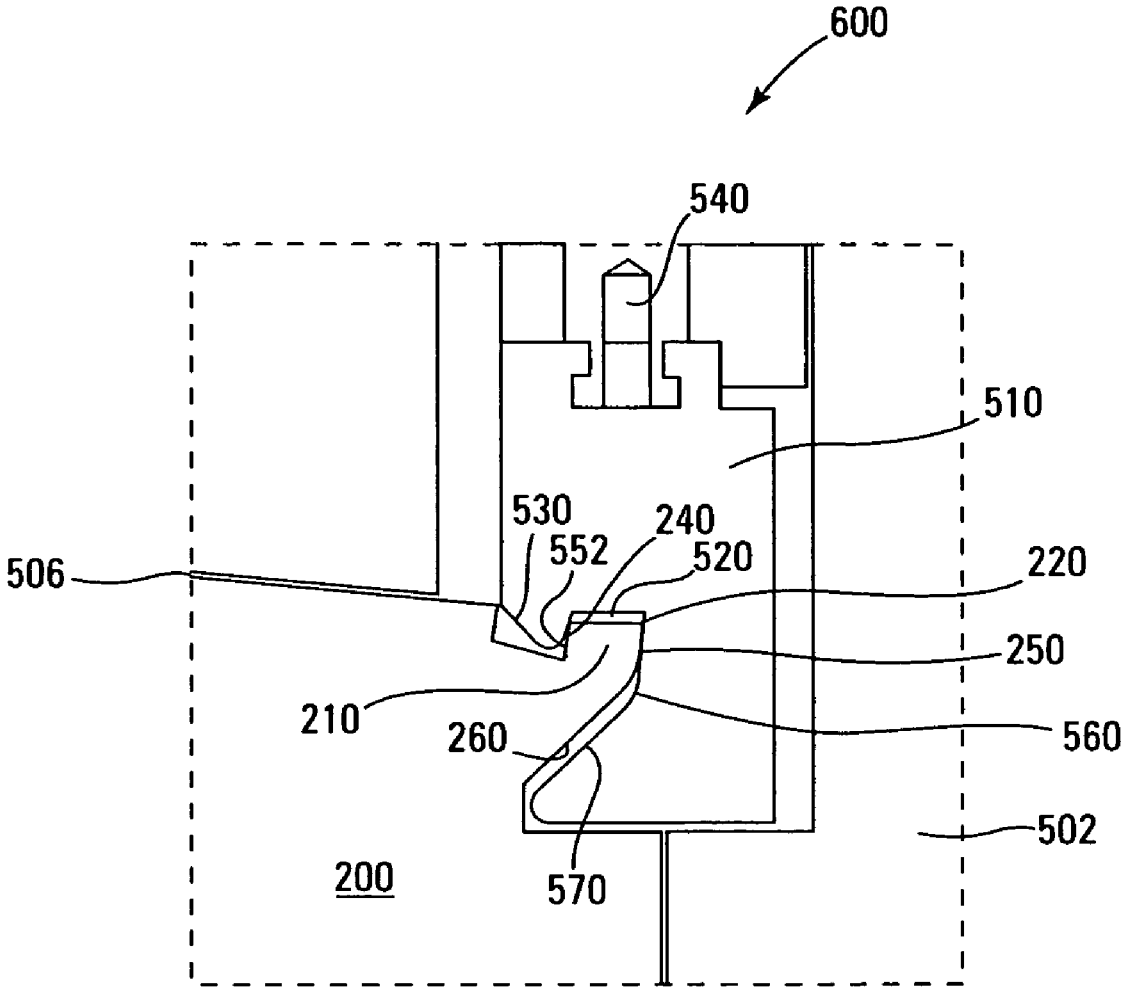
FIG. 6 is an enlarged view of region 600 of FIG. 5.

FIG. 6 is an enlarged view of region 600 of FIG. 5. The cross-hatching has been removed from FIG. 6 for clarity. For one embodiment, each insert 200 includes a protrusion (or lug) 210 that is received in a slot 520 (FIG. 6) of a latch 510 of a body portion 502 or 504 (FIGS. 5 and 6) for securing that insert 200 within its respective body portion, e.g., body portion 502. As an insert 200 is received in its respective opening 506, a surface 220 of lug 210 (FIG. 6) engages an inclined surface 530 of latch 510 that leads into slot 520 (FIG. 6). As insert 200 moves into the opening 506, surface 220 of lug 210 rides along inclined surface 530 of latch 510, exerting a force thereon that moves latch 510 away from the insert 200 and outward toward an exterior of body portion 502 (e.g., upward). Note that latch 510 is free to move, e.g., slide, as insert 200 is inserted into the opening 506. When lug 210 moves beyond angled surface 530, latch 510 moves toward the insert 200 and inward toward an interior of body portion 502 (e.g., downward) so that lug 210 is received in slot 520.

For one embodiment, a hydraulically driven ram 540 then exerts a downward force on latch 510. This causes an interior surface 552 of slot 520 (FIG. 6) to bear against a portion 240 of lug 210 for securing the insert 200 within the opening of its respective body portion.

As insert 200 is secured within its respective body portion, e.g., body portion 502, a portion 250 of lug 210 that is substantially opposite to portion 240 of lug 210 contacts an inclined inner surface 560 of slot 520 that is substantially opposite the inclined interior surface 552 (FIG. 6). To release insert 200 from body portion 502, ram 540 moves latch 510 upward, e.g., under hydraulic pressure, causing portion 250 of lug 210 to bear against the inclined inner surface 560 of slot 520. This releases insert 200 from its secured position. As latch 510 moves upward, portion 250 of lug 210 rides on inclined inner surface 560 of slot 520. For one embodiment, the angle of surface 560 provides sufficient force to break insert 200 loose from body portion 502, while advancing insert 200 from body portion 502 by a relatively short distance. An inclined surface 570, contiguous with inclined inner surface 560 of slot 520, but having a different inclination angle, e.g., less steep with respect to the horizontal, and leading out of slot 520, subsequently engages an inclined surface 260 of lug 210 that is contiguous with portion 250, but having a different inclination angle, e.g., less steep with respect to the horizontal. Inclined surface 570 rides along inclined surface 260 and exerts a force thereon that pushes insert 200 out of opening 506.

For one embodiment, inserts 200 are released from their respective body portions when rack 100 is disposed between the body portions, and releasing the inserts 200 pushes the inserts onto rack 100 so that studs 110 of jaws 108 align with the corresponding holes in either side of each die insert 200. Jaws 108 are then closed so that studs 110 are received in their corresponding holes of die inserts 200, as shown in FIG. 3, and so that jaws 108 squeeze die inserts 200 therebetween. The body portions are then separated, and rack 100 with the die inserts 200 clamped thereto is removed from between the separated body portions, e.g. using a crane or other lifting device.

Note that inserts 200 are butted together by butting body portions 502 and 504 together after rack 100 has been removed. Subsequently, molten metal is injected into the mold cavity formed by butting inserts 200 together. After the metal has sufficiently solidified, the body portions are moved apart and a cast object is removed from one of the inserts. The inserts are then removed from their respective body portions, clamped onto rack 100, and removed, as described above.

Figure 7:
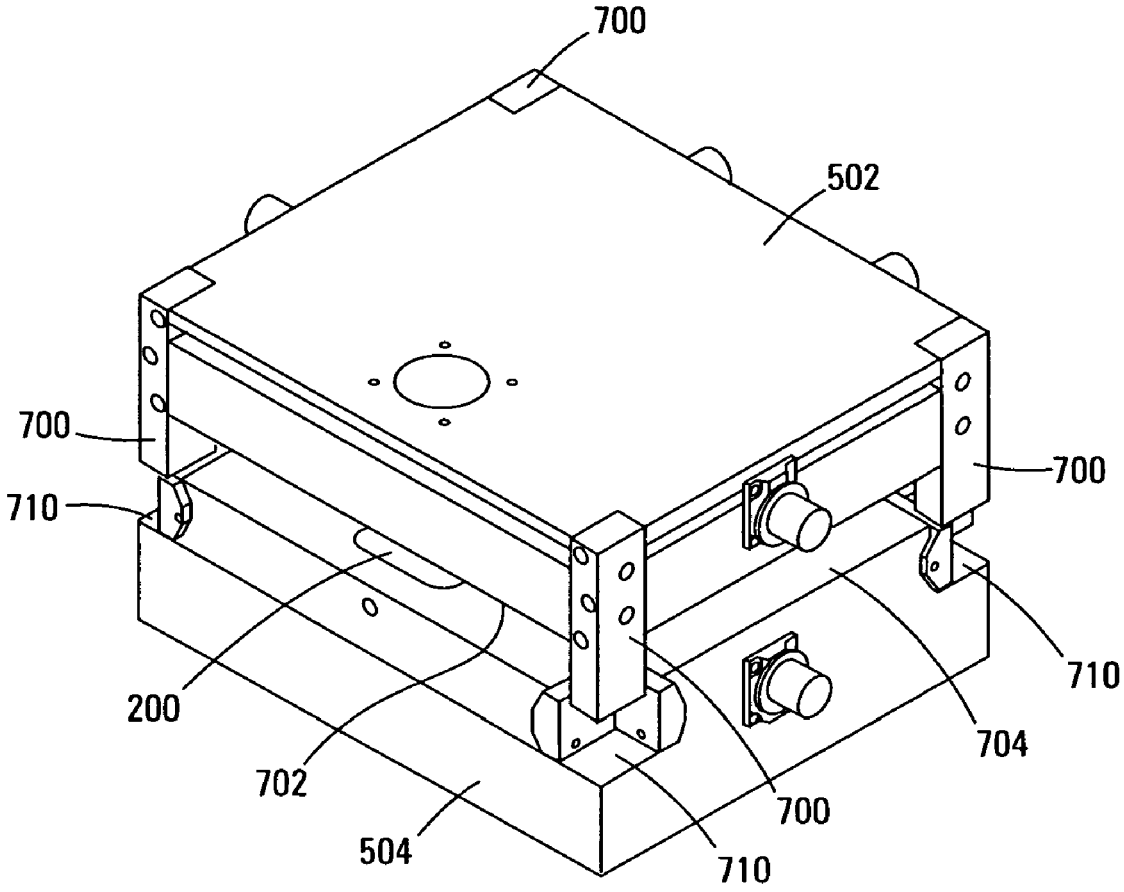
FIG. 7 is an isometric view illustrating a pair of body portions being butted together after die inserts have been inserted into the respective body portions, according to another embodiment of the invention.

FIG. 7 is an isometric view illustrating body portions 502 and 504 being butted together after inserts 200 have been inserted into the respective body portions and rack 100 has been removed, according to another embodiment of the present invention. The quality of the cast object depends on proper alignment (or registration) of the die inserts 200. Improper registration may result in an excessive parting line on the cast object corresponding to where the two die portions met that may require machining or that may produce an unacceptable part. Registration (or alignment) of body portions 502 and 504 registers die inserts 200.

For one embodiment, one of the body portions, e.g., body portion 502, has alignment blocks 700 attached at each of its corners by screwing or the like so that alignment blocks 700 extend beyond a face 702 of body portion 502, as shown in FIG. 7. Note that face 702 abuts a face 704 of body portion 504 when body portions 502 and 504 are butted together for casting. Moreover, inserts 200 are respectively substantially flush with faces 702 and 704.

Figure 8:
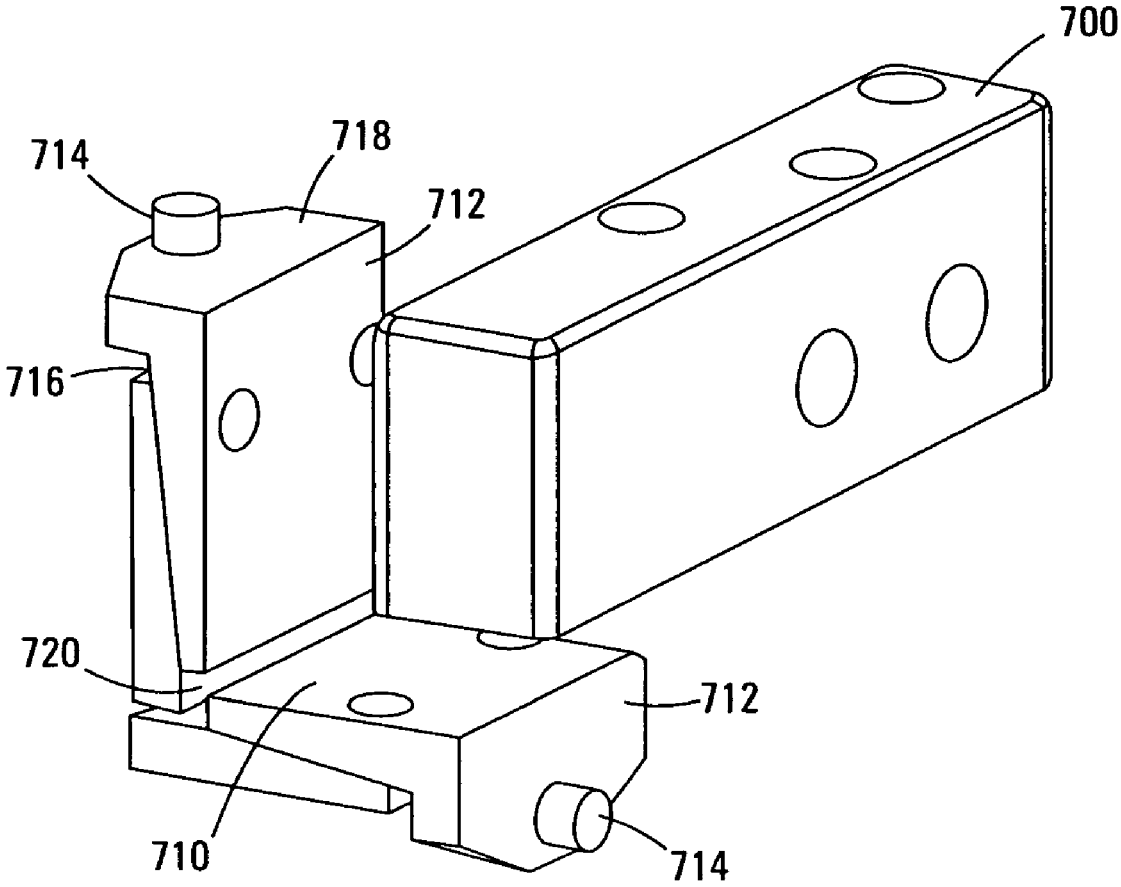
FIG. 8 is an enlarged isometric view of a recess receiving an alignment block, according to another embodiment of the invention.

As body portions 502 and 504 are butted together, each of alignment blocks 700 is received in a corresponding recess 710 at each of the corners of body portion 504, as shown in FIG. 7. Each recess 710 has selectively adjustable sidewalls 712 that are substantially perpendicular to each other, as shown in FIG. 8, an enlarged isometric view illustrating a recess 710 receiving an alignment block 700, according to another embodiment of the present invention. As an alignment block 700 is received in its corresponding recess 710, the alignment block 700 engages the adjustable sidewalls 712. This aligns (or registers) the respective body portions.

For one embodiment, adjustment screws 714 respectively actuate the adjustable sidewalls 712. For another embodiment, adjusting the sidewalls 712 adjusts the registration of the body portions by moving the sidewalls 712 against the alignment blocks 700, thereby adjusting the alignment of the inserts 200. Note that the respective substantially perpendicular adjustable sidewalls 712 of each recess 710 can respectively move the body portion 502 in substantially perpendicular directions. For another embodiment, sidewalls 712 are adjusted before butting body portions 502 and 504 together such that body portions 502 and 504 properly align when butted together.

For one embodiment, each adjustable sidewall 712 is formed by slidably engaging an inclined surface 716 of a wedge 718 and an inclined surface 720 of body portion 504, as shown in FIG. 8. Note that for one embodiment, adjustable sidewall 712 is a substantially flat surface of wedge 718 that faces generally opposite inclined surface 716 of wedge 718. For another embodiment, inclined surface 720 of body portion 504 is integrally formed with body portion 504, e.g., by machining, or is a wedge that is attached to body portion 504 by screwing or the like. The adjustment screw 714 is rotatably connected to wedge 720 and is threaded into the respective body portion.

Activation of adjustment screw 714 causes inclined surface 716 of wedge 718 to move, e.g., slide, over the stationary inclined surface 720 of body portion 504. The mating inclined surfaces 716 and 720 cause the substantially flat adjustable side surface 712 to move in a direction toward alignment block 700, e.g., when wedge 718 is moved into recess 710, and a direction away from alignment block 700, e.g., when wedge 718 is moved out of recess 710.

Figure 9A:
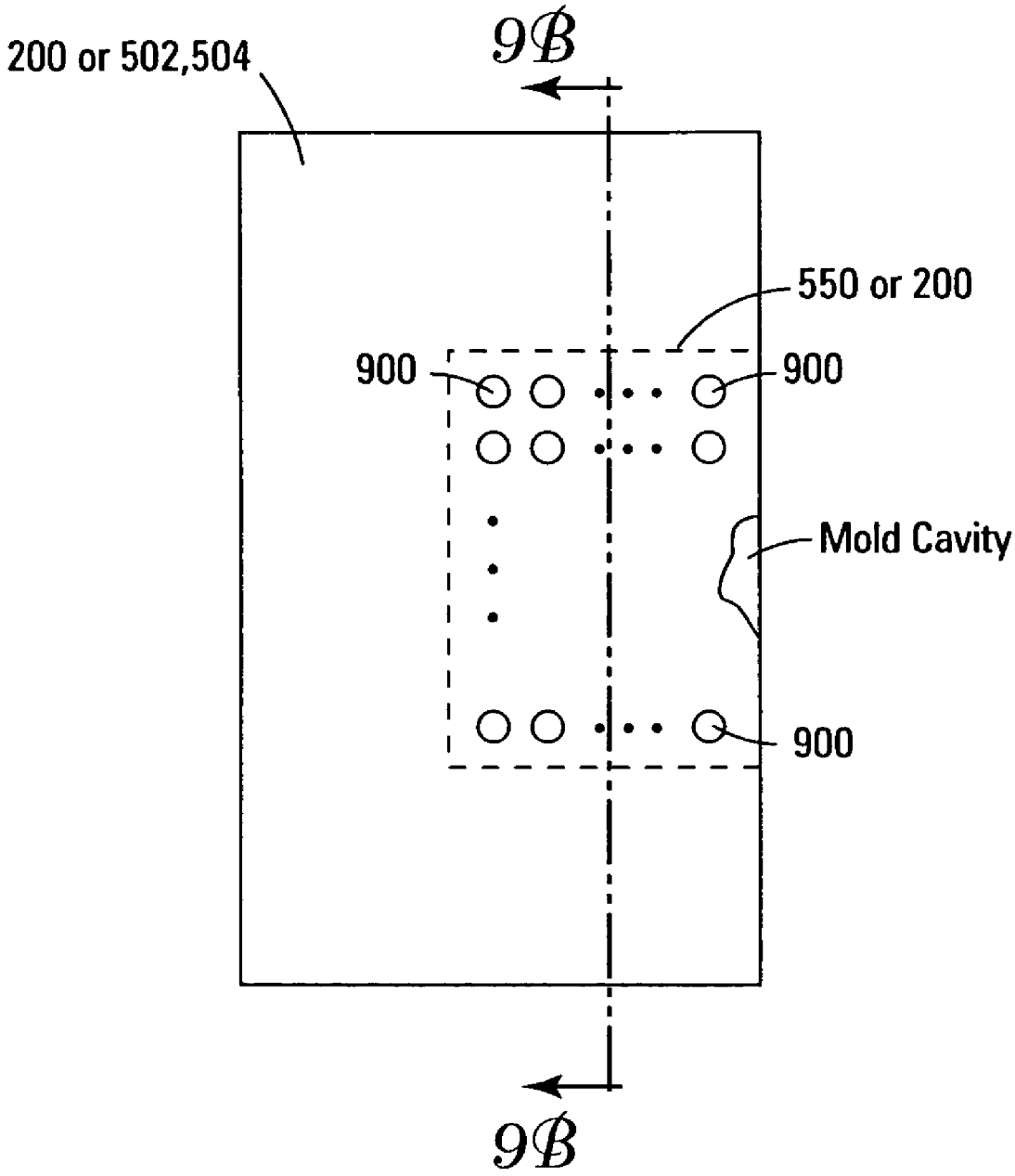
FIG. 9A is a top view illustrating a portion of a cooling system, according to another embodiment of the invention.

FIG. 9A is a top view of a die insert 200 containing a cavity insert 550, according to another embodiment of the invention, or a body portion, such as body portion 502 or 504, containing an insert 200, according to yet another embodiment of the invention. Therefore, it will be understood that in the ensuing discussion references to die insert 200 may alternatively refer to body portion 502 or 504, and references to cavity insert 550, may alternatively refer to die insert 200.

FIG. 9A illustrates an exemplary distribution of a plurality of cooling inserts 900, e.g., as an array of cooling inserts 900, of a cooling system for cooling cavity insert 550. However, cooling inserts 900 are not limited to an array, but may be distributed according to cooling requirements of cavity insert 550.

Figure 9B:
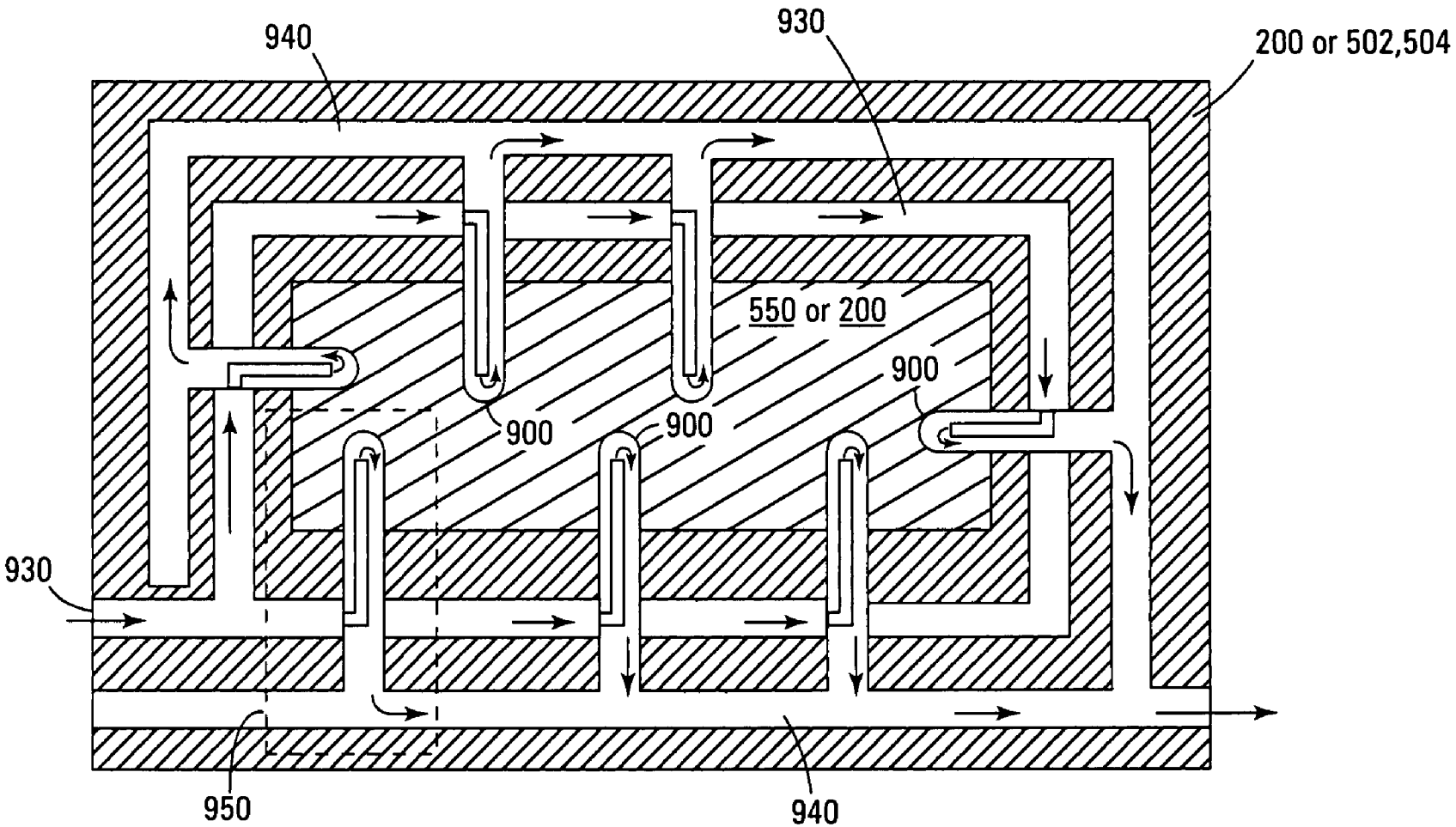
FIG. 9B is a cross-sectional view taken along line 9B—9B of FIG. 9A, according to another embodiment of the invention.

FIG. 9B is a cross-sectional view of die insert 200 taken along line 9B–9B of FIG. 9A, according to another embodiment of the invention. Cooling inserts 900 are connected in parallel between an inlet channel 930 formed in die insert 200 and an outlet channel 940 formed in die insert 200. As indicated by the arrows in FIG. 9B, coolant, such as water, oil, antifreeze, etc., enters inlet channel 930. For one embodiment, inlet channel 930 directs the coolant into a central core of each of cooling inserts 900. The coolant exits the central core, loops around, flows along the outside of the central core adjacent die insert 200, and flows into outlet channel 940.

For one embodiment, inlet channel 930 can be connected an outlet of a pump so that the coolant can be pumped into the cooling system. Alternatively, outlet channel 940 can be connected to an inlet of a pump while inlet channel 930 is connected to a coolant reservoir so that the coolant can be drawn through the cooling system. A flow restrictor, such as a throttle valve, orifice, etc., may be inserted in outlet channel 940 for back pressurizing the cooling system.

Figure 9C:
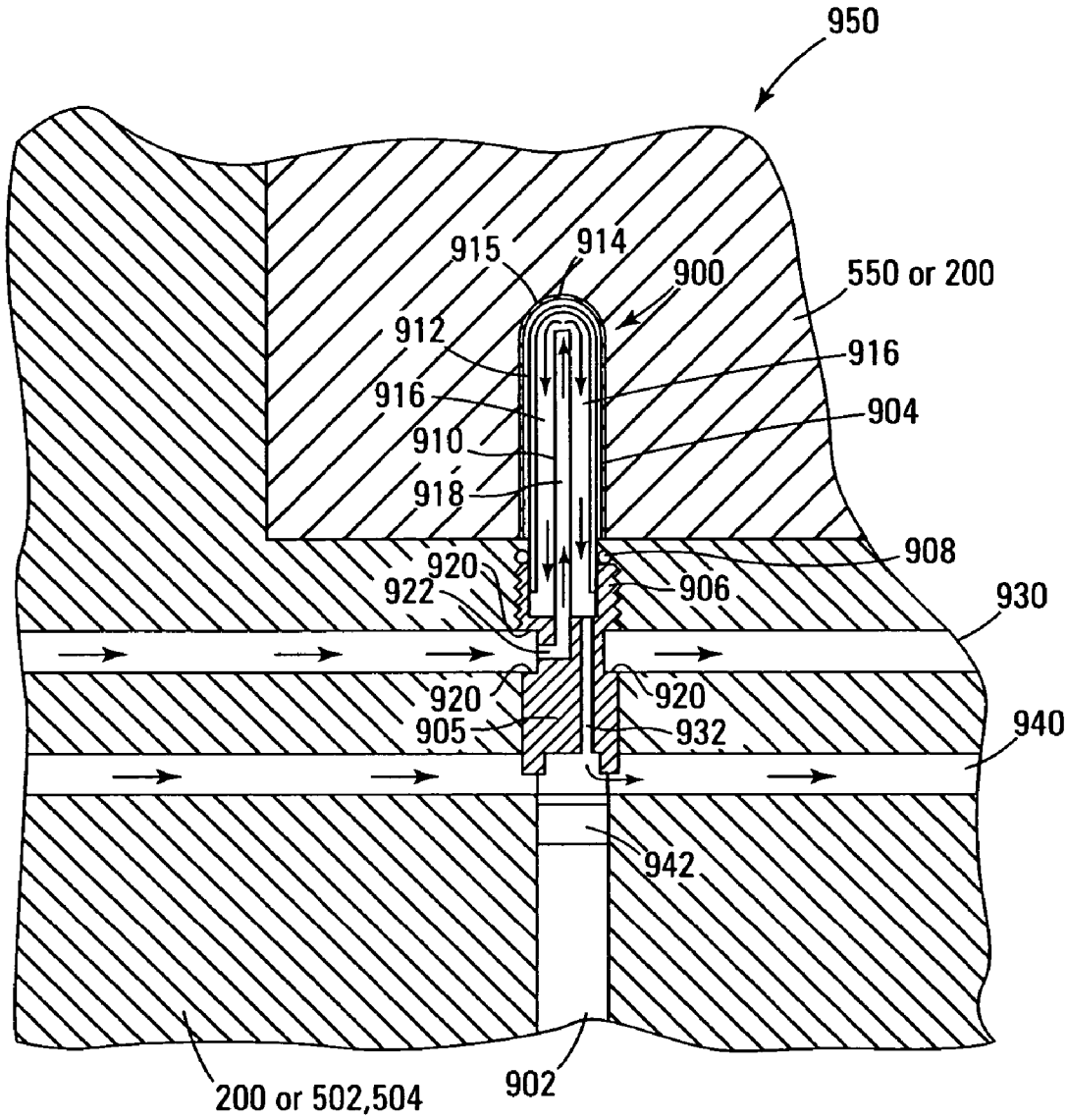
FIG. 9C is an enlarged view of region 950 of FIG. 9B.

FIG. 9C is an enlarged view of the region 950 of FIG. 9B. A cooling insert 900 is inserted through a hole 902 that passes completely through die insert 200. Note that cooling inserts 900 can be inserted around an entire periphery of die insert 200 for one embodiment, as shown in FIG. 9C. Cooling insert 900 extends into a blind hole 904 of cavity insert 550 that aligns with hole 902 when cavity insert 550 inserted into die insert 200. For one embodiment, a fitting portion 905 of cooling insert 900 includes threads 906 that thread into die insert 200 for securing cooling insert 900. For another embodiment, a seal 908, such as an O-ring, is disposed between fitting portion 905 insert 200.

Cooling insert 900 includes an inner conduit 910, e.g., a tube or pipe, that is integral with or otherwise connected to fitting portion 905 and is disposed within a shell 912 that is integral with or otherwise connected to fitting portion 905. Inner conduit 910 does not extend all the way to an end 914 of shell 912. An outer flow passage 916 is formed between inner conduit 910 and shell 912, and an interior of inner conduit 910 forms an inner flow passage 918 that opens into outer flow passage 916 adjacent end 914. For one embodiment, a thermal interface material 915, such as thermally conductive grease, is disposed between shell 912 and cavity insert 550 to thermally couple shell 912 and thus cooling insert 900 to cavity insert 550.

For one embodiment, fitting portion 905 has a groove 920 disposed around its perimeter. A radial bore 922 of fitting portion 905 opens into groove 920 and connects to flow passage 918. When cooling insert 900 is inserted into die insert 200 and cavity insert 550, groove 920 aligns with inlet channel 930. Moreover, an end of an axial bore 932 of fitting portion 905 fluidly connects outer flow passage 916 to outlet channel 940. For some embodiments, a first plug 942 is inserted into hole 902 for closing hole 902 after cooling insert 900 is inserted.

For other embodiments, a second plug (not shown) may replace cooling insert 900, e.g., by threading into die insert 200 instead of fitting portion 905, when there is no blind hole 904 of cavity insert 550 corresponding to a hole 902 of die insert 200. This enables a single die insert 200 to accommodate cavity inserts 550 having different cooling loads and thus requiring different cooling insert distributions. This also allows the cooling to be adjusted by selectively turning off or on various cooling inserts 900 using the second plugs.

In operation, the coolant enters inlet channel 930. Inlet channel 930 directs the coolant to radial bore 922 of cooling insert 900. Radial bore 922 directs the coolant to inner flow passage 918, which directs the coolant into outer flow passage 916 adjacent end 914 of shell 912. Outer flow passage 916 directs the coolant to axial bore 932, which directs the coolant to outlet channel 940.

For another embodiment, the mold cavity portions are respectively formed directly in a body portion and not in a die insert or a mold insert. For this embodiment, cooling inserts 900 are inserted into the body portions and are contained thereby. The inserts 900 are connected in parallel between inlet and outlet channels within the respective body portions.

Connecting cooling inserts 900 in parallel between inlet channel 930 and outlet channel 940 results in less variation in the coolant temperature from cooling insert to cooling insert compared to connecting cooling locations of a mold in series as is commonly done. This is because for the parallel configuration, the coolant does not pass through a cooling location before passing through a subsequent cooling location as it does for the series configuration. Passing the coolant through successive cooling locations in series causes the coolant to warm up before passing through each successive cooling location. Moreover, the parallel configuration enables various cooling locations to be selectively turned on or off.

CONCLUSION

For one embodiment, the invention provides a die casting system having an external die body that includes two distinct body portions, each having an opening for holding a die insert. Each die insert includes a portion of a mold cavity. When the two body portions, each containing a die insert, are butted together, the die inserts abut so that the mold-cavity portions form the mold cavity. The die casting system is capable of holding multiple different die inserts that have substantially identical external dimensions but different internal dimensions so that multiple parts can be cast using the same external body and replacing the inserts. This acts to reduce set-up time and fabrication costs.

Another embodiment provides a die-insert rack that holds the die inserts thereon and is used for positioning the die inserts between the two body portions. The rack includes a die-insert-ejection system for pushing the die inserts into the respective body portions.

For another embodiment, each body portion includes a plurality of cooling channels that are connected in parallel between inlet and outlet channels of the corresponding body portion. This acts to improve cooling compared to conventional cooling systems having series connected cooling channels that subsequently heat the coolant passing through these cooling channels.

For another embodiment, one body portion includes a plurality of alignment blocks protruding therefrom, while the other body portion has a plurality of recesses for respectively receiving the alignment blocks. Each recess has adjustable sidewalls for adjusting alignment between the body portions. This helps to compensate for alignment problems associated with system wear.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. A die-casting method comprising:

clamping a pair of die inserts to a rack so that the die inserts protrude from the rack in opposite directions, wherein each die insert comprises a portion of a mold cavity;

positioning the rack between a pair of separated body portions of an external die body so that each die insert aligns with an opening in a respective one of the body portions;

moving the body portions toward each other so as to sandwich the rack therebetween so that die inserts are received within their respective openings;

ejecting the die inserts from the rack;

latching the die inserts to their respective body portions within their respective openings;

moving the body portions apart;

removing the rack from between the body portions; and butting the body portions together, wherein latching the die inserts to their respective body portions comprises engaging a lug of each of the die inserts with a latch of the respective one of the body portions.

2. The method of claim 1, wherein butting the body portions together comprises receiving each of a plurality of alignment blocks protruding from one of the body portions in a corresponding one of a plurality of recesses of another of the body portions, wherein each of the recesses comprises adjustable sidewalls.

3. The method of claim 2, and further comprising adjusting the alignment between the body portions before or after butting them together by adjusting the positions of the adjustable sidewalls.

4. The method of claim 1, wherein ejecting the die inserts from the rack comprises pushing the die inserts from the rack using a pair of ejectors of the rack disposed between the die inserts and located adjacent opposite sides of the die inserts.

* * * * *